US007024728B2

(12) United States Patent
Muir

(10) Patent No.: US 7,024,728 B2
(45) Date of Patent: Apr. 11, 2006

(54) END CAP FOR MULTI BAR LINKAGE HINGE ASSEMBLY

(75) Inventor: Malcolm Muir, Honeoye Falls, NY (US)

(73) Assignee: Advantage Manufacturing Corp., Victor, NY (US)

( * ) Notice: Subject to any disclaimer, the term of this patent is extended or adjusted under 35 U.S.C. 154(b) by 398 days.

(21) Appl. No.: 10/073,730

(22) Filed: Feb. 11, 2002

(65) Prior Publication Data

US 2003/0150084 A1 Aug. 14, 2003

(51) Int. Cl.
*E05D 15/00* (2006.01)

(52) U.S. Cl. ..... 16/366; 16/221

(58) Field of Classification Search ..... 16/366, 16/221; 248/903, 300
See application file for complete search history.

(56) References Cited

U.S. PATENT DOCUMENTS

| | | | | |
|---|---|---|---|---|
| 81,477 | A | | 8/1868 | Cohen |
| 125,657 | A | | 4/1872 | Brinser |
| 133,298 | A | | 11/1872 | Brinser |
| 147,869 | A | | 2/1874 | Seng |
| 163,661 | A | | 5/1875 | Keiper |
| 185,543 | A | | 12/1876 | Jones |
| 185,613 | A | | 12/1876 | Wolfinger |
| 402,388 | A | | 4/1889 | Belches |
| 824,367 | A | | 6/1906 | Lamb |
| 934,726 | A | | 9/1909 | Henry |
| 1,128,620 | A | | 2/1915 | Munzner |
| 1,279,246 | A | | 9/1918 | Bunch |
| 1,506,241 | A | | 8/1924 | Jensen |
| 1,596,470 | A | | 8/1926 | Way et al. |
| 1,613,187 | A | | 1/1927 | Mullen |
| 1,653,651 | A | | 12/1927 | McKellar |
| 1,696,685 | A | | 12/1928 | Leutz |
| 1,715,032 | A | | 5/1929 | Hoegger |
| 1,833,972 | A | | 12/1931 | Olson |
| 1,854,440 | A | | 4/1932 | Aldeen |
| 1,998,319 | A | | 4/1935 | Johnson |
| 2,032,109 | A | | 2/1936 | Bolesky |
| 2,065,700 | A | | 12/1936 | Horst |
| 2,182,704 | A | | 12/1939 | Rea |
| 2,212,882 | A | | 8/1940 | Marsh |
| 2,488,222 | A | | 11/1949 | Morgan |
| 2,605,925 | A | | 8/1952 | Morin |
| 2,630,522 | A | | 3/1953 | MacDougall |
| 2,731,229 | A | * | 1/1956 | Seitz ..... 248/300 |
| 2,784,459 | A | | 3/1957 | Anderberg et al. |
| 2,807,829 | A | | 10/1957 | Goebel |
| 2,815,529 | A | | 12/1957 | Herbolsheimer et al. |
| 2,872,698 | A | | 2/1959 | Gommels |
| 3,186,756 | A | | 6/1965 | Saut et al. |
| 3,210,808 | A | | 10/1965 | Creager |
| 3,328,833 | A | | 7/1967 | Wustner |
| 3,345,777 | A | | 10/1967 | Anderbert et al. |

(Continued)

*Primary Examiner*—Robert J. Sandy
*Assistant Examiner*—Michael J. Kyle
(74) *Attorney, Agent, or Firm*—Brian B. Shaw, Esq.; Stephen B. Salai, Esq.; Harter, Secrest & Emery LLP

(57) ABSTRACT

An end cap for a supporting bracket having a multi bar linkage includes at least one reinforcing rib. The reinforcing rib extends along a seating portion of the end cap, which engages a track of the supporting bracket and along a length of an upstanding portion of the end cap. End caps configured for offset or inline supporting brackets can include the reinforcing ribs.

11 Claims, 2 Drawing Sheets

U.S. PATENT DOCUMENTS 3,467,983 A 9/1969 Lipking
3,633,647 A 1/1972 Leitgeb
3,722,142 A 3/1973 Anderberg et al.
3,908,477 A 9/1975 Taske et al.
4,013,253 A * 3/1977 Perrault et al. ..... 248/222.51
4,202,083 A * 5/1980 Gutner ..... 29/897
4,364,201 A 12/1982 Taylor
4,381,581 A 5/1983 Ludvik
4,501,045 A 2/1985 Boyer
4,555,829 A 12/1985 Davis
4,571,776 A 2/1986 Taylor
4,674,149 A 6/1987 Vetter
4,689,852 A 9/1987 Buckley
4,718,144 A 1/1988 Buckley
4,833,754 A 5/1989 Yang
4,914,783 A 4/1990 Jackson et al.
4,930,185 A 6/1990 Hutton
4,980,947 A 1/1991 McQuigge
5,081,743 A 1/1992 Mayes
5,083,344 A 1/1992 Pettit et al.
5,191,679 A 3/1993 Harper
5,255,471 A 10/1993 Shaw et al.
5,287,596 A 2/1994 Chen et al.
5,535,482 A 7/1996 Grabber
5,673,459 A 10/1997 Baghdasarian
5,809,617 A 9/1998 Harris et al.
5,846,018 A * 12/1998 Frobosilo et al. ..... 403/403
5,898,977 A * 5/1999 Muir ..... 16/363
6,073,405 A * 6/2000 Kasai et al. ..... 52/283
6,138,325 A 10/2000 Figliola et al.
6,192,645 B1 * 2/2001 Benz et al. ..... 52/656.1

* cited by examiner

END CAP FOR MULTI BAR LINKAGE HINGE ASSEMBLY

FIELD OF THE INVENTION

The present invention relates to supporting brackets for windows, and particularly, to multi-bar hinge linkage supporting brackets arranged to support a window for pivotal movement about either a vertical axis or a horizontal axis, and more particularly, to an end cap assembly for such supporting brackets.

BACKGROUND OF THE INVENTION

Multi-bar hinge linkage supporting brackets are employed for the support of casement type or projection type windows. That is, the supporting brackets support the windows to permit a pivotal movement about a vertical axis or a horizontal axis. The supporting brackets are also adapted to be connected between a conventional window frame and a window sash, whether the structures be formed of metal, wood, plastic, PVC, composites or structural materials. The supporting brackets are typically arranged to cause the pivot axis of the window to move to and from the window frame so that when the window is opened, both surfaces of the window are accessible from inside of the window frame.

The supporting brackets can be configured to be employed on either the left or right side of a window (non-handed bracket) or be specific to a left or right side of the window (handed).

The advantages of windows having supporting brackets has resulted in increased use of the supporting brackets. The increased use has resulted in increased applications, wherein the applications of the supporting brackets requires increased capacity. Specifically, the supporting brackets are subject to increased loading and sealing requirements. While increased material thickness in the supporting bracket can partially accommodate the increased load requirements, the size of the supporting brackets is limited.

Therefore, the need exists for a supporting bracket having increased load capacity, while retaining traditional sizing restrictions. The need also exists for reducing failure of a supporting bracket under relatively high loading.

SUMMARY OF THE INVENTION

The present invention provides an end cap for a supporting bracket having a multi-bar linkage hinge assembly, wherein the hinge assembly generally includes an elongate track and a linkage. The linkage typically includes at least one arm, which can be coupled to a window, and a slider coupled between the arm and a track. The arm is moveable between (i) a closed position in which the slider is carried by the track and the arm generally overlies the track; and (ii) an open position in which the slider is disposed along the track and the arm extends at an angle with respect to the track.

The linkage can include a plurality of bars including the four-bar hinge as disclosed herein.

In the closed position, the supporting bracket resists outward or inward forces on the connected window, depending on the window product type. These forces result from pressure loading, as well as seal compression. In addition, the supporting bracket must accommodate certain safety factors, with respect to the loading.

Design requirements have placed larger loads on the multi-bar linkage supporting brackets. The present invention provides an increased structural capacity of the supporting bracket by enhancing the capacity of the end cap.

The end cap of the present construction includes a seating portion sized to cooperatively engage the track, and an upright portion. The upright portion can include a plurality of facets for selectively capturing a portion of the linkage. The end cap includes at least one reinforcing rib extending from the seating portion to the upright portion. Preferably, each facet of the upright portion includes a reinforcing rib.

The reinforcing rib extends along the upright portion to terminate prior to a terminal end of the upright portion, thereby allowing a continuous surface for engaging the linkage as in prior end cap assemblies. Thus, the present end cap can be integrated into existing supporting brackets without requiring adjustment of the existing bracket.

In one construction, the seating portion, the upright portion and the reinforcing rib are formed of a single contiguous, integral piece of material.

DETAILED DESCRIPTION OF THE PREFERRED EMBODIMENT

Figure 1:
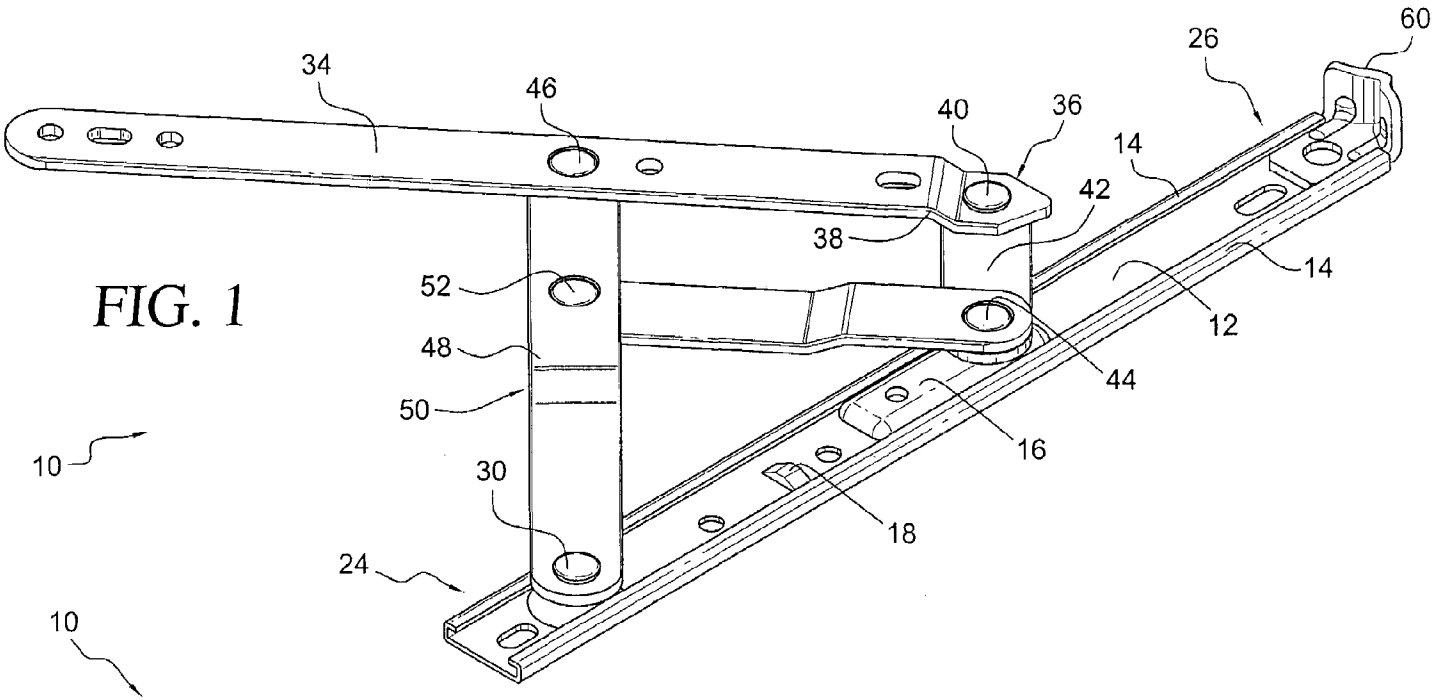
FIG. 1 is a perspective view of a multi-bar linkage supporting bracket in an open position employing the present end cap.
Figure 2:
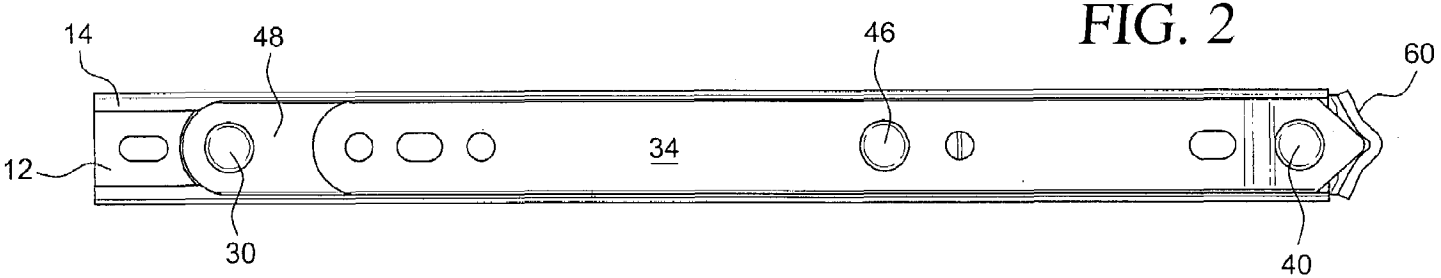
FIG. 2 is a top plan view of the supporting bracket of FIG. 1 in the closed position.
Figure 3:
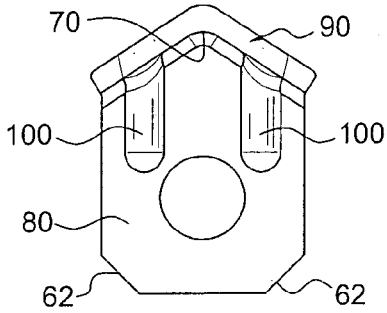
FIG. 3 is a top plan view of a first configuration of the present end cap.
Figure 8:
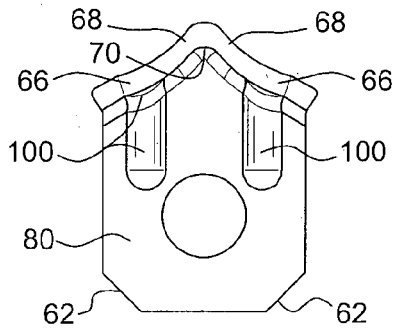
FIG. 8 is a top plan view of a second configuration of the end cap.
Figure 4:
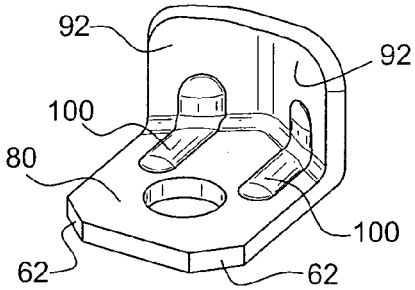
FIG. 4 is a front perspective view of the end cap of FIG. 3.
Figure 9:
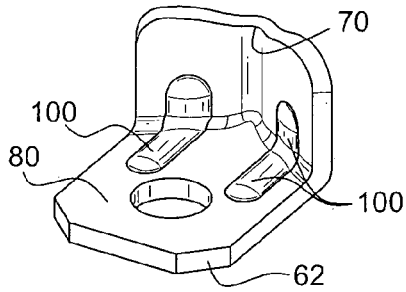
FIG. 9 is a front perspective view of the end cap of FIG. 8.
Figure 5:
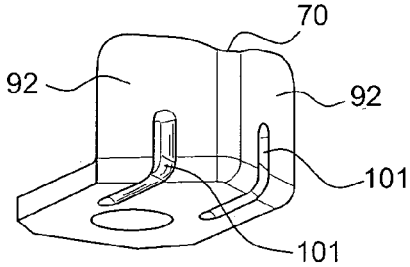
FIG. 5 is a rear perspective view of the end cap of FIG. 3.
Figure 10:
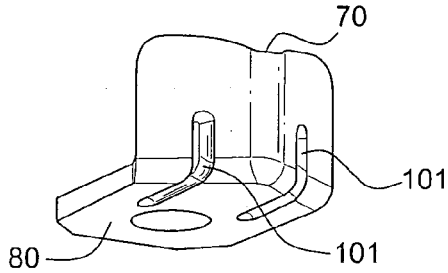
FIG. 10 is a rear perspective view of the end cap of FIG. 8.
Figure 6:
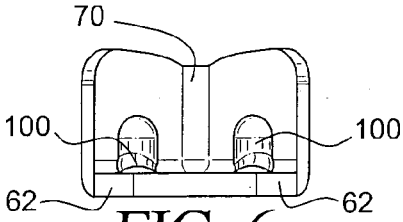
FIG. 6 is a front elevational view of the end cap of FIG. 3.
Figure 11:
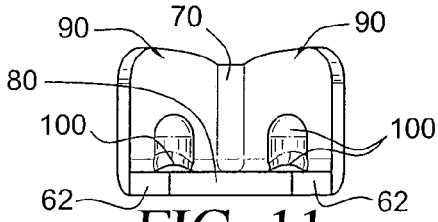
FIG. 11 is a front elevational view of the end cap of FIG. 8.
Figure 7:
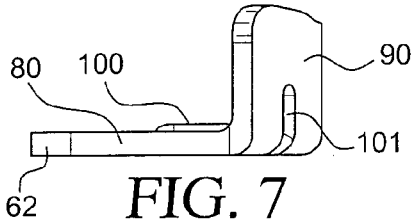
FIG. 7 is a side elevational view of the end cap of FIG. 3.
Figure 12:
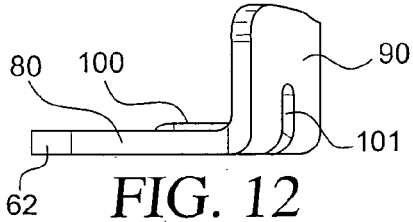
FIG. 12 is a side elevational view of the end cap of FIG. 8.

As shown in FIG. 1, a supporting bracket 10 can be positioned in one of many open positions. The supporting bracket 10 is constructed to interconnect a window frame and a window sash. The window sash is frictionally restrained in any angular position to which the supporting bracket 10 is moved. This frictional restraint may be provided partly by the friction at the pivotal connections between the various elements, but is largely provided by the frictional engagement between the slider and the track, as will be discussed.

The supporting bracket 10 may be positioned on any side of a window, and is generally provided in pairs. Each supporting bracket 10 includes a track 12 having folded side flanges 14. The track 12 is secured by screws to the window frame, not shown, preferably with one end 26 of the track 12 adjacent a corner of the window frame.

Mounted on the track 12 is a slide 16 having side flanges, which fit under and are retained by the side flanges 14. The slide 16 is preferably a solid brass shoe for smooth, long-lasting performance. The slide 16 is provided with a shallow raised portion forming a cavity confronting the track 12. Mounted within the cavity or raised portion may be a friction adjuster pad 20. The slide 16 may be provided with two or more adjustment screws 22 for maximum friction adjustment.

The slide 16 is slidable between the end 26 of the track member 12, adjacent the corner of a window frame and a position near the opposite or extended end 24. The end 24 of the track remote from the corner of the window frame may be provided with a raised boss 18 extending to a level flush with the upper surfaces of the side flanges 14. The boss can be provided with a pivot pin or rivet. In addition, a washer may be used. The washer is preferably a nylon-bearing washer.

Secured to the confronting side of the window sash by screws is a substantially flat vent bar 34. When the window sash is in its closed position within the window frame, the vent bar 34 overlies or confronts the track 12 with one end 36 adjacent the end 26 of the track 12 disposed in the corner of the window frame. Near this end 36 of the bar 34, there is provided a downward offset 38 and pivot pin or rivet 40.

A short link 42 is pivotally connected between the pivot pin 40 and a pivot pin 44 provided on top of the slide 16.

The vent bar 34 is provided with a second pivot pin 46. A strut 48 extends between the pivot pin 46 and pivot pin 30 at the remote end 24 of the track 12. The pivot pin 46 is so located that when the bar 34 is in superposed relation with the track 12, the strut 48 is interposed between the track 12 and vent bar 34 and is in alignment with the vent bar. This is likewise true of the link 42.

A portion of the strut 48 is offset upwardly as indicated by 50. Within the length of the upwardly offset portion is a pivot pin 52. A brace 54 extends between a pivot pin 52 and the pivot pin 44 of the slide 16. The length of the short link 42, between the pivot pins 40 and 44 and the length of the brace 54 between the pivot pins 44 and 52 combined are equal to the portion of the strut 48 between the pivot pins 52 and 46, plus the portion of the bar 34 between the pivot pins 46 and 40. The pivot pins 40, 44, 52, and 46 define a four-sided figure. The vent bar 34, the short link 42, the strut 48, and the brace 54 are preferably all made from stainless steel and are preferably provided with rounded edges, as will be discussed further below for precluding interference of the adjacent hinge elements under load during an opening or closing operation. Together, the four elements 34, 42, 48, and 54 define what is known in the industry as a "four bar hinge". Although only four bars, 34, 42, 48, and 54 are disclosed, it should be understood that additional bars may be included for heavier windows, such as a cross-link connecting the brace 54 to the bar 34.

It is desirable that the window sash fit tightly against the window frame when the window sash is in the closed position. In a preferred embodiment, this is accomplished by end cap 60 secured to the end 26 of the track 12 adjacent the corner of the window frame. As seen in FIGS. 3–7, the end cap 60 includes a seating portion 80 and an upright portion 90. The seating portion is sized to be at least partially received within the track 12, and is preferably provided with two tapered corners 62 for easy insertion between the side flanges 14 of the track. The end cap 60 is then preferably staked, crimped or pressed to the track 12, but may be spot welded or riveted, otherwise secured to the track 12.

The upright portion 90 can define at least one facet 92 and preferably, a pair of facets intersecting and joined along an apex, or center seam 70. The facets 90 of the upright portion 90 are disposed in an intersecting orientation to meet along the center seam 70. The upright portion 90 of the end cap 60 can have planar facets (FIGS. 3–7) or camming facets (FIGS. 8–12). As seen in FIGS. 3–7, each facet 90 is a substantially planar member. Alternatively, as seen in FIGS. 8–12, each facet includes camming surfaces in the form of a crimp or a wave.

In the camming surface configuration, the upright portion 90 can include facets 92 having angularly related camming surfaces 64. In the camming surface configuration, each camming surface 64 includes a first surface 66. The first surfaces 66 preferably extend upwardly from the seating portion at approximately right angles. Second surfaces 68 of the camming surface 64 are disposed at non-zero (>180°) angles relative to the first surfaces 66. The non-zero angle is preferably in the range of approximately 190° to 210°, and preferably 203°. The first surfaces 66 are flared outwardly a bit more than necessary to ensure collection of the vent bar end 36. The second surfaces 68 join together, preferably at an acute angle, in the range of approximately 70° to 90°, and preferably 80°, to form a central recess 70.

The end 36 of the vent bar 34 includes two angled sections leading to a tip. As the vent bar 34 moves into its superposed position relative to the track 12, one of the angled sections engages a corresponding camming surface 64 (or planar facet) and draws the sash and window tightly together. The angled section of the vent bar 34 first engages the first surface 66, and slides along first surface 66 until the other angled section abuts the second surface 68 of the opposite camming surface 64. Then, the end is urged into its home position with the tip nestled between the two second surfaces 68 of the central seam 70.

The geometry of the end cap 60 is such that the end of the vent bar 34 first engages the camming surface 64 with a surface of the angled section rather than with just the tip of the vent bar. This large contact area allows for immediate "pull-in" of sash to prevent weather strip problems.

When the end 36 is collected within the central seam 70, the second surfaces 68 provide a dual sided containment area for the vent bar 34 which prevents any sash play. That is, with the end of the vent bar 34 contacted on both angled sections by the end cap 60, the end of the vent bar is prohibited from jiggling within the end cap 60 which could otherwise result in air and water leakage in the weather-strip. From this closed position, the supporting bracket may be moved in either the A or B direction without binding. Thus, the supporting bracket 10 can be mounted on any side of a window.

The end cap 60 also allows for easy opening of windows without the binding experienced in prior art supporting brackets. When the supporting bracket 10 is opened, the reverse of a closing scenario described above is realized. First, one of the surfaces of the angled section of the vent bar 34 abuts one of the second surfaces 68. Then, the other angled section of the vent bar 34 abuts an opposite first surface 66 (that is, a first surface from the other camming surface 64). The hinge elements then move freely out of the end cap 60 and assume the desired open configuration.

The end cap 60 of the present invention can be manufactured in a variety of ways. Preferably, a mold/stamping die is prepared for forming the end cap 60 with the appropriate dimensions. Alternatively, an end cap 60 with two straight facets can be dropped in a nest and crimped to form the seating portion and the upright portion with the first and second surfaces. It is understood, however, this would require a second operation.

Preferably, the end cap 60 is formed from a single integral contiguous piece of material such as metal, which is stamped/molded to the final operable configuration. Thus, the end cap can be formed from flat stock, which is stamped to the desired shape.

As seen in FIGS. 3–12, the end cap 60 includes a reinforcing rib 100 extending along a section of the seating portion 80 and the upright portion 90. The reinforcing rib 100 has a length extending along the seating portion 80 and a length extending along the upright portion 98. The reinforcing rib 100 extends a height above an adjacent section of the seating portion 80 or the upright portion.

The length of the reinforcing rib 100 extending along each portion of the end cap 60 is at least partially dictated by the intended loading conditions. It has been found a length of the reinforcing rib of approximately 0.2 to 0.5 inches along the seating portion 80 and a length of the reinforcing rib of approximately 0.015 to 0.2 inches along the upright portion 90 is sufficient to increase the load capacity of the end cap 60. However, it has been found a reinforcing rib extending along 0.3 to 0.4 inches along the seating portion 80 and 0.015 to 0.030 inches along the upright portion 90 to be sufficient to increase the capacity of the end cap 60.

Although the reinforcing rib 100 can be formed of added metal or material welded to the seating portion 80 and the upright portion 90, in a preferred configuration, the reinforcing rib 100 is formed by a deformation of the original material, rather than a material adding step. Therefore, the end cap 60 can include a channel (or recess) 101 extending along an outside surface of the end cap, wherein the channel corresponds to the rib extending along the inside surface of the end cap.

Thus, the reinforcing rib 100 as it projects from the inside (upper) surface of the seating portion 80 and the upright portion 90, a corresponding recess 101 is formed in the outside (underside) of the seating portion and the outside surface of the upright portion.

The raised height of the reinforcing rib 100, relative to the adjacent section of the end cap 60, is at least partially dictated by the anticipated forces acting on the upright portion.

In addition, the reinforcing rib 100 does not extend the full height of the upright portion. The reinforcing rib 100 ends at a terminal end 102 on the upright portion 90. Preferably, the upright portion 90 extends a sufficient distance above the terminal end 102 of the reinforcing rib 100 to define a sufficient contacting or camming surface for contacting the linkage, such that upon operable engagement with the corresponding portion of a linkage, the linkage does not ride over or engage the reinforcing ribs 80.

Further, although each facet 92 of the upright portion 90 is shown having a corresponding reinforcing rib 100, it is understood that some upright facets may be formed without he reinforcing rib, while other facets may include two or more reinforcing ribs.

Although the thickness of the seating portion 80 and the upright portion 90 is generally dictated by the size of the corresponding track 12, a typical material thickness for the end cap 60 is between approximately 0.080 inches to 0.090 inches. The reinforcing rib height, at least, partially depends upon the intended operating forces to be exerted upon the end cap and may range from approximately 0.025 to 0.045 inches above the adjacent surface of the seating portion 80 and the upright portion 90. Thus, the reinforcing rib 100 can have a height of approximately 25% to 60% the thickness of the seating portion 80, or the upright portion 90.

It has been found the end cap 60 with reinforcing rib 100, as set forth herein, can withstand up to 170 pounds per square foot, in contrast to prior end cap constructions that failed at approximately 120 pounds per square foot. That is, the reinforcing rib 100 allows the end cap 60 to withstand 170 pounds per square inch acting on the upright portion in a direction parallel to the seating portion.

As the end cap 60 can include the reinforcing ribs 100 in either the inline or handed (offset) configuration of the support bracket, the end cap can be used in an inline assembly or an offset assembly.

While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

The invention claimed is:

1. An improved multi-bar linkage hinge assembly including a supporting bracket having an elongate track, the improvement comprising:

(a) an end cap having a seating portion and an upright portion, the seating portion configured to engage the track; and (b) at least one reinforcing rib extending from the seating portion to the upright portion, the reinforcing rib including added metal.

2. The improved multi-bar linkage hinge assembly of claim 1, wherein the seating portion; the upright portion and the reinforcing rib are formed of an integral single piece of metal.

3. The improved multi-bar linkage hinge assembly of claim 1, wherein the upright portion includes at least two facets, and a reinforcing rib extending along each facet.

4. The improved multi-bar linkage hinge assembly of claim 1, wherein the seating portion and the upright portion include a recess on an outside surface corresponding to the reinforcing rib.

5. The improved multi-bar linkage hinge assembly of claim 1, wherein the upright portion includes a pair of camming facets, each camming facet including a pair of camming surfaces.

6. The improved multi-bar linkage hinge assembly of claim 1, wherein reinforcing rib extends along the seating portion a greater length than the reinforcing rib extends along the upright portion.

7. The improved multi-bar linkage hinge assembly of claim 1, wherein the reinforcing rib, the seating portion and the upright portion are sized to withstand 170 pounds per square inch acting on the upright portion in a direction parallel to the seating portion.

8. The improved multi-bar linkage hinge assembly of claim 1, wherein the reinforcing rib has a height between approximately 25% to 60% a thickness of one of the seating portion and the upright portion.

9. An end cap for a multi bar linkage supporting bracket having a track, the end cap comprising:

(a) a seating portion selected to cooperatively engage the track;

(b) an integral upright portion extending from the seating portion; and (c) an integral reinforcing rib extending along a length of the seating portion and the upright portion, the reinforcing rib including added metal.

10. The end cap of claim 9, wherein the upright portion includes at least two facets.

11. The end cap of claim 9, wherein each facet includes a reinforcing rib.

* * * * *